US008955827B2

(12) United States Patent
Brown

(10) Patent No.: US 8,955,827 B2
(45) Date of Patent: Feb. 17, 2015

(54) SCRAPER BAR

(75) Inventor: Joshua Brown, New Haven, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 510 days.

(21) Appl. No.: 13/336,311

(22) Filed: Dec. 23, 2011

(65) Prior Publication Data

US 2013/0160214 A1 Jun. 27, 2013

(51) Int. Cl.
*B66F 15/00* (2006.01)

(52) U.S. Cl.
USPC ..... 254/25; 254/21

(58) Field of Classification Search
CPC ..... B66F 15/00; B25F 1/00
USPC ..... 254/21, 25, 19
See application file for complete search history.

(56) References Cited

U.S. PATENT DOCUMENTS

| | | | | |
|---|---|---|---|---|
| 546,521 | A | 9/1895 | Gatti | |
| 886,987 | A | 5/1908 | Kiehle | |
| 1,486,820 | A | 3/1924 | Wilder | |
| 1,508,489 | A | 9/1924 | Vlchek | |
| 2,330,092 | A | 9/1943 | Vanasse | |
| 2,593,304 | A | 4/1952 | Howard | |
| 2,863,635 | A | 12/1958 | Fandrich | |
| 2,896,910 | A | 7/1959 | Cooper et al. | |
| 3,134,574 | A | 5/1964 | Reuterfors | |
| 3,522,932 | A | 8/1970 | Nakasone | |
| 4,844,416 | A | 7/1989 | Hand | |
| 5,207,126 | A | 5/1993 | Schaben | |
| 5,322,264 | A | 6/1994 | Giambro | |
| 5,459,897 | A | 10/1995 | Wurdack | |
| D386,057 | S | 11/1997 | Hreha | |
| 5,695,171 | A | 12/1997 | Shine | |
| 5,695,172 | A * | 12/1997 | Hreha | 254/25 |
| 5,820,107 | A | 10/1998 | Hall | |
| 5,850,657 | A | 12/1998 | List et al. | |
| 5,957,429 | A | 9/1999 | Khachatoorian | |
| D444,690 | S | 7/2001 | Bond | |
| 6,257,553 | B1 | 7/2001 | Khachatoorian | |
| 6,598,857 | B1 | 7/2003 | Hernandez et al. | |
| 6,663,083 | B1 | 12/2003 | Smith | |
| 6,715,734 | B1 | 4/2004 | Wise | |
| 6,752,380 | B1 | 6/2004 | Taylor et al. | |
| D493,086 | S | 7/2004 | Taylor et al. | |

(Continued)

OTHER PUBLICATIONS

Richard US-10 Lever Bar 10" Scraper. [online] Ace Tool Repair, Inc., 2011 [retrieved in Aug. 2011]. Retrieved from the Internet <URL: http://www.acetoolonline.com/Richard-US-10-Lever-Bar-10-Scraper-p/ric-us-10.htm>.

(Continued)

*Primary Examiner* — Lee D Wilson
(74) *Attorney, Agent, or Firm* — Pillsbury Winthrop Shaw Pittman LLP

(57) ABSTRACT

A tool configured to engage a work piece includes an elongated body portion and a generally U-shaped hook extending from a first end of the body portion. The generally U-shaped hook may have first and second leg portions and a bight portion connected between the leg portions. The tool is devoid of structure above the bight portion of the generally U-shaped hook, thus enabling a work piece to be received within the generally U-shaped configuration. The first leg portion includes a scraper edge terminating the generally U-shaped hook. The generally U-shaped hook also includes a pivot configured to translate a pulling of the body portion into a prying action against the work piece by the first leg portion.

29 Claims, 3 Drawing Sheets

(56) References Cited

U.S. PATENT DOCUMENTS

| | | | | |
|---|---|---|---|---|
| D506,118 | S | 6/2005 | Rau et al. | |
| 6,901,621 | B2 * | 6/2005 | Bruneau | 7/166 |
| 6,901,644 | B1 | 6/2005 | Rich | |
| 6,959,917 | B2 | 11/2005 | Hernandez et al. | |
| 6,962,326 | B2 | 11/2005 | Else | |
| 7,185,879 | B1 | 3/2007 | Lejuez | |
| 7,503,545 | B2 | 3/2009 | Verbowski | |
| 7,618,031 | B2 | 11/2009 | Weaver et al. | |
| D627,617 | S | 11/2010 | Chambers | |
| 7,967,277 | B2 | 6/2011 | Chambers | |
| 8,567,760 | B2 * | 10/2013 | Sindt | 254/25 |
| 2004/0026674 | A1 | 2/2004 | Hernandez et al. | |
| 2005/0062026 | A1 * | 3/2005 | Holcomb | 254/25 |
| 2008/0001129 | A1 | 1/2008 | Weaver et al. | |
| 2008/0191181 | A1 | 8/2008 | Verbowski | |
| 2008/0217592 | A1 * | 9/2008 | Chambers | 254/25 |
| 2008/0295254 | A1 | 12/2008 | Meekins | |
| 2010/0115705 | A1 | 5/2010 | Allen et al. | |
| 2013/0160214 | A1 * | 6/2013 | Brown | 7/158 |

OTHER PUBLICATIONS

Stainless HD Scrape and Pry Bar. [online] Hi-Tech Glazing Supplies [retrieved in Aug. 2011]. Retrieved from the Internet <URL: http://www.hitechglazing.com/product/1839356/40212>.

Stiletto FB11G 11-½-Inch Titanium Multifunctional Glazer Bar. [online] Google Product Website [retrieved in Aug. 2011]. Retrieved from the Internet <URL:http://www.google.com/products/catalog>.

Titan 11505 5-½-Inch PRY Bar Scraper. [online] Google Product Website [retrieved in Aug. 2001]. Retrieved from the Internet <URL: .google.com/products/catalog>.

* cited by examiner

SCRAPER BAR

FIELD OF THE INVENTION

The present invention relates generally to utility bars.

BACKGROUND OF THE INVENTION

Utility bars are tools that are utilized for prying or otherwise provide mechanical advantage (i.e. for nail removal), demolition, or other applications of force. Conventional utility bars having a scraper edge have an L-shaped cross section, with an elongated body, curving at a pivot point into a scraper or nail prying edge that extends outwards from a direction of elongation of the elongated body. Alternatively, utility bars having a hooked engagement portion with a work piece generally have a wedge shape that extends through hook, such that a prying action drives the wedge shape into the work piece. Among other things, the present application endeavors to improve prying and scraping functions over conventional utility bars.

SUMMARY OF THE INVENTION

According to an embodiment, a tool configured to engage a work piece includes an elongated body portion and a generally U-shaped hook extending from a first end of the body portion. The generally U-shaped hook may have first and second leg portions and a bight portion connected between the leg portions. The tool is devoid of structure above the bight portion of the generally U-shaped hook, thus enabling a work piece to be received within the generally U-shaped configuration. The first leg portion includes a scraper edge terminating the generally U-shaped hook. The generally U-shaped hook also includes a pivot configured to translate a pulling of the body portion into a prying action against the work piece by the first leg portion.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

Features of the tool in accordance with one embodiment are shown in the drawings, in which like reference numerals designate like elements. The drawings form part of this original disclosure in which.

DETAILED DESCRIPTION OF THE ILLUSTRATED EMBODIMENT(S)

Figure 1:
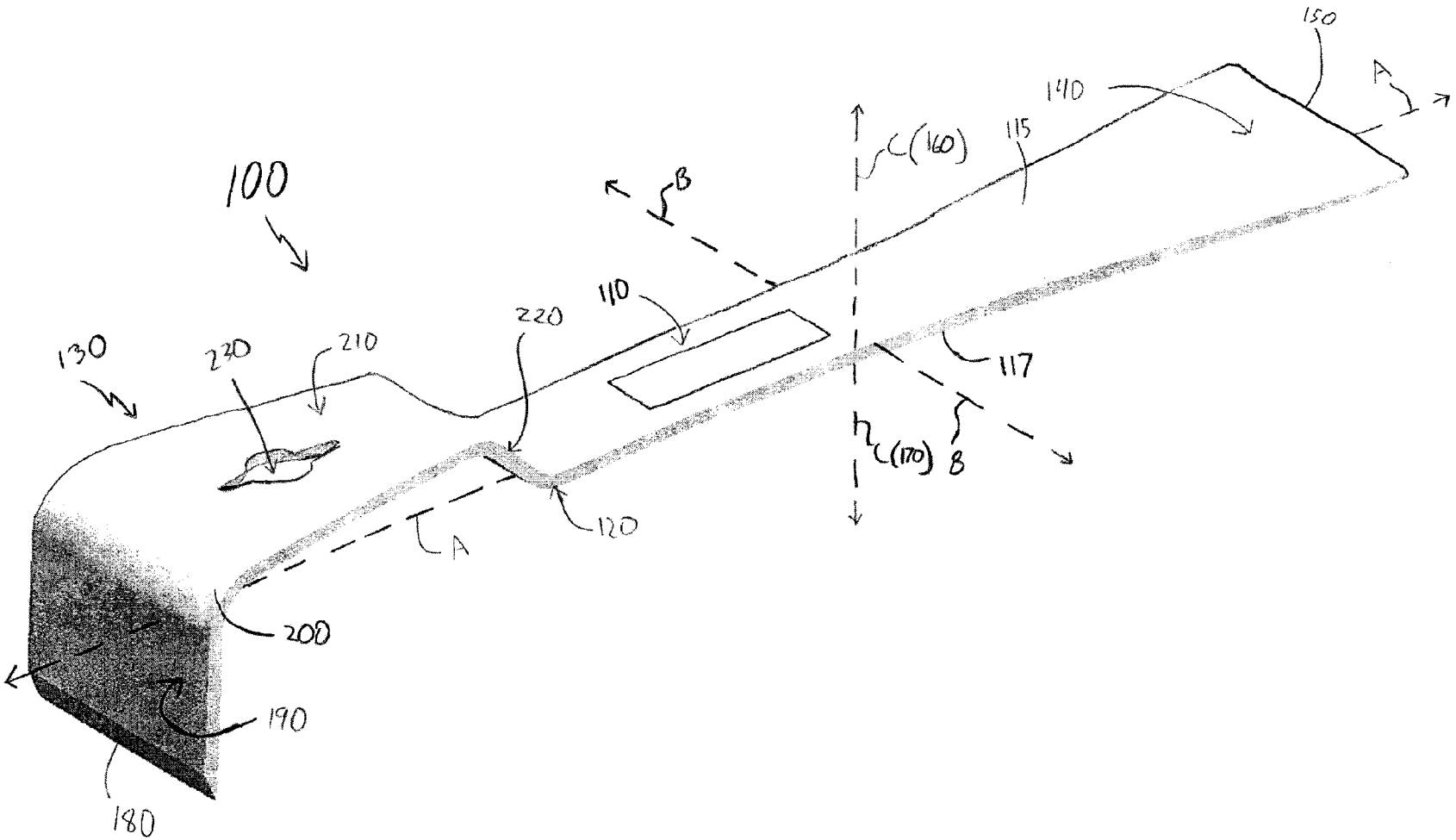
FIG. 1 is a perspective view of an embodiment of a scraper bar of the current disclosure.

FIG. 1 depicts a perspective view of an embodiment of a scraper bar 100 of the current disclosure. As shown, in some embodiments the scraper bar 100 may be formed of a single uniform body that may be cut and bent to appropriate dimensions. It may be appreciated that in some such embodiments the scraper bar 100 may be blanked or otherwise cut from a sheet or roll in one or more cutting or stamping operations, before being formed by one or more additional stamping operations. In some embodiments, the forming of the scraper bar 100 may include cold and/or hot forming operations. Additionally, the scraper bar 100 may be ground, sanded, or otherwise processed to remove burrs or other imperfections that may result from the blanking or cutting processes. While in the illustrated embodiment, the scraper bar 100 is formed from a single piece of metal, it may be appreciated that in other embodiments, the scraper bar 100 may be formed from a plurality of components that may be welded, fused, bonded, fastened, or otherwise coupled together. Materials for the scraper bar 100 may vary across embodiments, and may include, for example, metals such as one or more of aluminum, brass, bronze, mild steel, stainless steel, or any other appropriate metal or alloy. In other embodiments, scraper bar 100 may be formed from durable non-metals such as hard plastics or composites. Additionally, in some embodiments grip material, such as rubber or elastomer, may be applied or otherwise installed around a portion of the metal or other durable material of scraper bar 100, so as to increase user comfort when engaging the scraper bar 100.

As shown in FIG. 1, scraper bar 100 includes an elongated body portion 110. The elongated body portion 110 of the illustrated embodiment is generally planar, and may extend along a first axis A (i.e. an axis of elongation for the elongated body portion 110). In the illustrated embodiment, it may be appreciated that a first surface 115 of the elongated body portion 110 may be flat, such that the first surface 115 is generally positioned at the first axis A. Extending from a first end 120 of the elongated body portion 110 is a generally U-shaped hook 130, described in greater detail below. It may be appreciated that the generally U-shaped hook 130 may extend away from the first axis A in various embodiments. In the illustrated embodiment, a second end 140 of the elongated body portion 110 terminates in a scraper edge 150. In the illustrated embodiment, the scraper edge 150 is continuous and flat, although it may be appreciated that in some embodiments a nail pulling aperture may be formed to engage a nail therein. As shown, in some embodiments the second end 140 may expand outwards such that the scraper edge 150 is generally wider along a second axis B, generally perpendicular to the first axis A, than the remainder of the elongated body portion 110. In the illustrated embodiment, it may be appreciated that the flat first surface 115 of the elongated body portion 110 may also be positioned at the second axis B. Furthermore, it may be appreciated that the scraper edge 150, extending along the second axis B, may be formed by reducing a thickness of the elongated body portion 110 (i.e. in a third axis C, generally perpendicular to the first axis A and the second axis B) to create the thinner or sharper scraper edge 150. In the illustrated embodiment, a second surface 117 of the elongated body portion 110, which otherwise may extend along an axis parallel to the first axis A, may taper towards the first surface 115, so as to form the thinner or sharper scraper edge 150. In an embodiment, the second end 140 of the elongated body portion 110 may be considered the region of the elongated body portion 110 where a generally uniform thickness along the third axis C begins to thin to create the scraper edge 150.

Although in the illustrated embodiment the second end 140 and the scraper edge 150 are generally within a plane defined by axes A and B (i.e. a plane AB), it may be appreciated that in some embodiments the second end 140 and/or the scraper edge 150 may be angled to be oriented out of the plane AB, either through a gradual curve or a sharp fold at least partially in either a first direction 160 or a second direction 170 of the third axis C. In some embodiments where the second end 140 and/or the scraper edge 150 are oriented towards the second direction 170 of the third axis C, the scraper edge 150 may generally not extend further into the second direction 170 than the U-shaped hook 130, as described in greater detail below. It may be appreciated that the axial coordinates provided herein establish an exemplary frame of reference, and are not intended to dictate an exact spatial alignment for the scraper bar 100. As such, extension or movement in any direction parallel to one or more of the axes A, B, or C may be considered extension or movement in the direction of that axis or those axes.

As indicated above, the U-shaped hook 130 may extend from the first end 120 of the elongated body portion 110. Similarly to the second end 140, in some embodiments the U-shaped hook 130 and/or the first end 120 may extend outwards along the second axis B so that the U-shaped hook 130 may be wider than the elongated body portion 110. Although the U-shaped hook 130 may vary across embodiments, it may be appreciated that the U-shaped hook 130 is shaped to receive a work piece within the U-shape thereof, so as to provide greater leverage when performing a prying action using the scraper bar 100. Although the U-shape of the U-shaped hook 130 may open to any appropriate direction, in the illustrated embodiment, the U-shaped hook 130 opens towards the second direction 170 along the third axis C, by curving initially towards the first direction 160, before generally extending in the direction of the first axis A, and subsequently curving back towards the second direction 170, as described in greater detail below.

As shown in FIG. 1, the U-shaped hook 130 terminates distal from the elongated body portion 110 at a scraper edge 180. In the illustrated embodiment, the scraper edge 180 is continuous and flat in the direction of the second axis B, and extends from an exterior portion 190 of the U-shaped hook 130. As shown in the illustrated embodiment, the exterior portion 190 of the U-shaped hook 130 may be generally flat, and may extend generally along the third axis C (i.e. generally perpendicular to the direction of elongation for the elongated body portion 110). Additionally, the exterior portion 190 may be of a generally uniform thickness prior to tapering at the edge thereof in the dimension of the first axis A into the scraper edge 180.

Adjacent to the exterior portion 190 is an exterior curve 200, that couples the exterior portion 190 to an intermediate portion 210 of the U-shaped hook 130. As described in greater detail below, the exterior curve 200 facilitates a prying action against the work piece received in the U-shaped hook 130, when the elongated body portion 110 is pulled in the first direction 160. In particular, it may be appreciated that at least a portion of the exterior curve 200 comprises a pivot point for the scraper bar 100. While in the illustrated embodiment the exterior curve 200 has an arcuate cross section, in some non-preferred embodiments, the exterior curve 200 may comprise an angular joining of the exterior portion 190 and the intermediate portion 210, whereby the pivot point would be the vertex of the angle. While in some embodiments the exterior curve 200 may comprise a plurality of angles, which may approximate a continuous curve, in other embodiments the exterior curve 200 may comprise a single angle, such as a right angle joining the exterior portion 190 with the intermediate portion 210.

As shown, in some embodiments the intermediate portion 210 may be generally flat. For example, in an embodiment the intermediate portion 210 may extend generally in a direction parallel to but offset from the first axis A, such that the intermediate portion 210 is offset from the plane of the elongated body portion 110 by an offset amount in the first direction 160. In another embodiment, the intermediate portion 210 may also be generally flat, however may extend at an angle formed between the first axis A and the third axis C. In still other embodiments, the intermediate portion 210 may be curved, multifaceted, or of any other appropriate shape.

To initially establish the U-shape of the U-shaped hook 130, the intermediate portion 210 is coupled to the elongated body portion 110 by an interior portion 220. It may be appreciated that the interior portion 220 may extend generally along the third axis C, and extend from the elongated body portion 220 in either the first direction 160 or the second direction 170 depending on the direction in which the U-shaped hook 130 opens. As shown in the illustrated embodiment, where the U-shaped hook opens towards the second direction 170, the interior portion 220 may extend from the first end 120 in the first direction 160. While in some embodiments, such as that illustrated the interior portion 220 may curve from the first end 120 of the elongated body portion 110, in other embodiments the joint between the interior portion 220 and the elongated body portion 110 may form a sharp joint, such as at a right or acute angle. In some embodiments, the interior portion itself may be generally flat, extending at least partially in the direction of the third axis C. In other embodiments, the interior portion 220 may be curved, multifaceted, or of any other appropriate shape. As with the exterior portion 190, while in some embodiments the interior portion 220 may curve into the intermediate portion 210, in other embodiments the interior portion 220 of the U-shaped hook 130 may form an angle with the intermediate portion 210.

As illustrated, the U-shape of the U-shaped hook 130 may then be generally formed with the exterior portion 190 comprising a first leg of the U-shaped hook 130, while the interior portion 220 may comprise a second leg of the U-shaped hook 130. The intermediate portion 210 may be considered a bight of the U-shaped hook 130, connecting the first leg and the second leg (i.e. the exterior portion 190 and the interior portion 220).

It may be appreciated that at least a portion of the U-shape of the U-shaped hook 130 may extend into the direction of the third axis C relative to the elongated body portion 110 (i.e. away from the first axis A). While in the illustrated embodiment some of the exterior portion 190 extends forward in the second direction 170 relative to the elongated handle portion 110, it is appreciated that U-shaped hook 130 may be devoid of structure within the interior of the U-shape (i.e. the region surrounded by the exterior portion 190, the intermediate portion 210, and the interior portion 220), so that a work piece may be received into the U-shaped hook 130. As such, the work piece may be received further in the first direction 160 than the axis A, whereby the elongated body portion 110 may be forward of at least a portion of the work piece. It may be appreciated that where the work piece is trim or another sort of edge work, the elongated body portion 110 would not otherwise interfere with receiving the work piece within the U-shaped hook 130. By pulling on the elongated body portion 110 in the first direction 160 of the third axis C, the scraper bar 100 may pivot on the exterior curve 200, such that the exterior portion 190 may engage the work piece to facilitate a prying action against the work piece received in the U-shaped hook 130. For example, where the work piece is adhered or bonded to a substrate, the scraper edge 180 may initially separate the work piece from the substrate, and act as a wedge to allow the exterior portion 190 of the U-shaped hook 130 to be positioned therebetween. As indicated above, and shown in the illustrated embodiment, the thickness of the exterior portion 190 of the U-shaped hook 130 may generally be uniform until it tapers along the first axis A to form the ramp or wedge shape of scraper edge 180. It may be appreciated that by having such a uniform thickness, the exterior portion 190 may prevent distortion of the work piece and/or the substrate when a user of the scraper bar 100 is performing the prying function. Additionally, such prevention of distortion of the work piece and/or the substrate may also be facilitated by the continuous and flat nature of the scraper edge 180, wherein divots, gaps, or nail pulling apertures of conventional utility bars may prevent uniform insertion of the U-shaped hook 130 between the work piece and the substrate. Thus, by pulling on the elongated handle portion 110 in the first direction 160, the scraper bar 100 may pivot on the exterior curve 200, so that the generally flat exterior portion 190 may pry the work piece away from the substrate, while an increased amount of leverage u facilitated by the pivot of the exterior curve 200 being further into the first direction 160 than the elongated body portion 110 that is receiving the pulling action from the user.

Further shown in the embodiment of FIG. 1 is a nail pulling aperture 230 formed in the intermediate portion 210 of the U-shaped hook 130. As described in greater detail below, the nail pulling aperture 230 may be configured to receive the head of a nail therein, and facilitate pulling the nail away from a substrate into which the nail is driven. It may be appreciated that by positioning the nail pulling aperture 230 on the intermediate portion 210, the continuous and flat scraper edge 180 remains uniform so as to prevent distortion of a work piece or substrate as the scraper bar 100 is inserted therebetween. Additionally, the nail pulling aperture 230 may facilitate utilizing the exterior curve 200 as the pivot point to exert force on the head of the nail, whereby the elongated body portion 110 may be pulled in the second direction 170, pivoting the intermediate portion 210 away from the substrate (wherein the exterior portion 190 pivots towards the substrate), to pull a nail engaged in the nail pulling aperture 230 out of the substrate.

FIGS. 2-5 depict additional views of the scraper bar 100, including relative dimensions according to one non-limiting embodiment. While in some embodiments the dimensions indicated therein may be in millimeters, in other embodiments the dimensions may be utilized to indicate relative size according to one embodiment. As may be appreciated from the relative dimensions, the exterior portion 190, which may engage the work piece during the prying action, may be a generally uniform thickness that may be significantly greater in the plane AB than in the plane AC, so as to reduce distortion of the work piece or the substrate during the prying action. Although the width in the plane AB may vary, it may be appreciated that greater dimension in the plane AB over the plane AC may be constant throughout the scraper bar 100. the In the illustrated embodiment, the width to thickness ratio of the exterior portion 190 is approximately 40:2.5 (i.e. 16:1), in other embodiments the width to thickness ratio may be generally greater than 3:1, including for example, being generally greater than 4:1, being generally greater than 6:1, being generally greater than 8:1, or so on. In other embodiments, the width to thickness ration may be greater than that illustrated. For example, in some embodiments the width to thickness ratio may be generally greater than 16:1, including, for example, being generally greater than 18:1, or being generally greater than 20:1.

Figure 2:
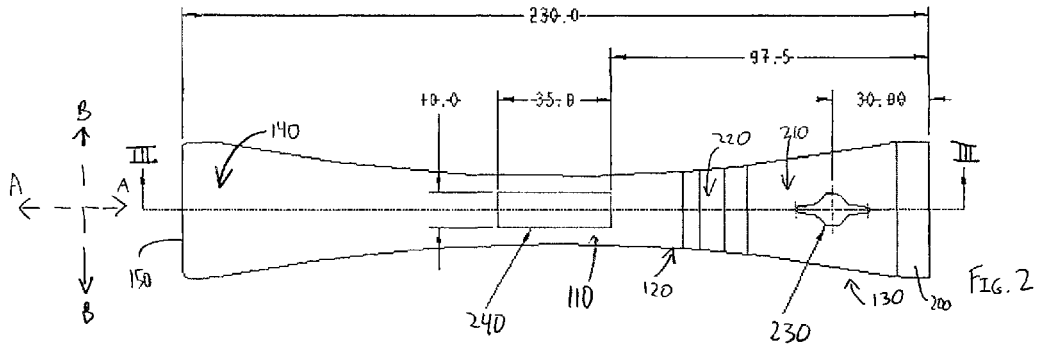
FIG. 2 is a top view of the scraper bar of FIG. 1.
Figure 4:
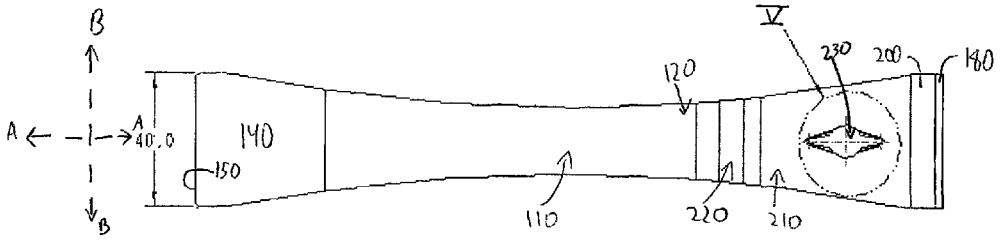
FIG. 4 is a bottom view of the scraper bar of FIG. 1.

As is appreciable from the top view of FIG. 2 and the bottom view of FIG. 4, in some embodiments the elongated body portion 110 and portions of the U-shaped hook 130 may comprise a generally continuous curved shapes on opposing sides in the plane AB, such that the width to thickness ratio may vary throughout the length of the scraper bar 100. As shown in FIG. 2, in some embodiments a generally central region 240 of the scraper bar 100 in the view of the plane AB, which is generally proximal to the end 120 of the elongated body portion 110 in the illustrated embodiment, may include space for logo or other markings or indicia of brand or source. In some embodiments, such indicia may be stamped, etched, cut, or otherwise formed into the scraper bar 100.

Figure 3:
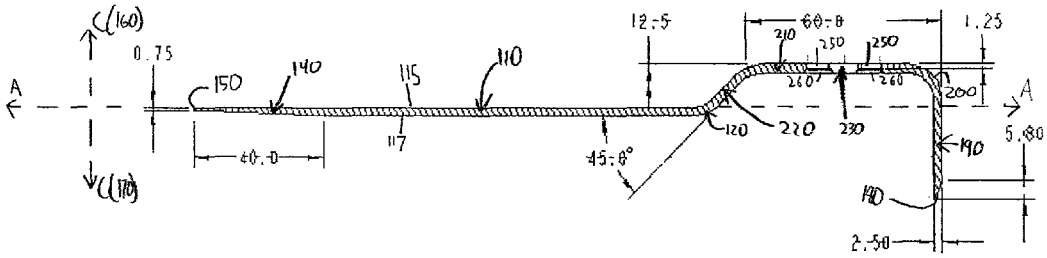
FIG. 3 is a side cross-sectional view of the scraper bar of FIG. 1.

FIG. 3 depicts a cross sectional view of scraper bar 100, cut across line III of FIG. 2. As shown, the cross sectional view of FIG. 3 extends through the symmetrical center of the scraper bar 100 in the plane AB, and thus extends through the center of the nail pulling aperture 230, described in greater detail below. It may be appreciated, however, that generally solid portions 250 and beveled edges 260 of the nail pulling aperture 230 may be appreciated in the cross sectional view, and may facilitate driving under the head of a nail received in the nail pulling aperture 230, such that the nail may be engaged by the scraper bar 100.

Figure 5:
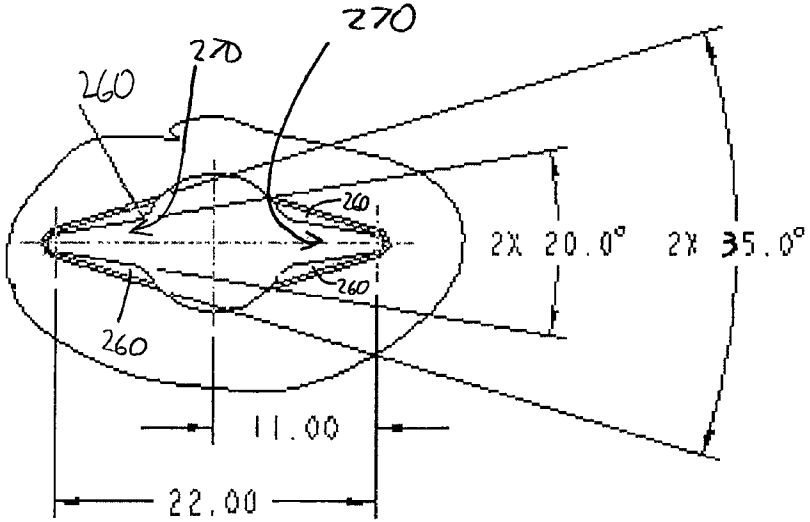
FIG. 5 is an enlargement of a portion of the bottom view of FIG. 4, enlarging a nail, pulling aperture formed therein.

Although the beveled edges 260 of the nail pulling aperture 230 are visible in the view of FIG. 4, the arrangement is enlarged in Detail V, depicted in FIG. 5. Specifically, it may be appreciated that in the illustrated embodiment nail pulling aperture 230 may comprise a pair of opposing nail engaging wedges 270, each comprising a pair of the beveled edges 260 that are angled towards each other. Thus, as a nail head is received in the nail pulling aperture 230, and the scraper bar is slidably positioned along the nail, the beveled edges 260 of the nail engaging wedge 270 may pull the nail out of the substrate slightly, positioning the beveled edges 260 between the head of the nail and the substrate. Thus, by pulling on the elongated body portion 110 in the second direction 170, the shaft of the nail may be pulled out of the substrate from the engagement of the head of the nail and the nail pulling wedge 270.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tool configured to engage a work piece, the tool comprising:

an elongated body portion; and a generally U-shaped hook extending from a first end of the elongated body portion, said generally U-shaped hook having first and second leg portions and a bight portion connected between the leg portions, the tool being devoid of structure above the bight portion of the generally U-shaped hook, thus enabling a work piece to be received within the generally U-shaped configuration;

the first leg portion comprising a scraper edge at a linear end portion thereof, the scraper edge terminating the generally U-shaped hook;

the generally U-shaped hook comprising a pivot configured to translate a pulling of the elongated body portion into a prying action against the work piece, received in the generally U-shaped hook, by the first leg portion, and wherein the generally U-shaped hook is generally of a uniform thickness until tapering at the linear end portion of the first leg portion into the scraper edge.

2. The tool of claim 1, wherein the elongated body portion and the generally U-shaped hook are integrally formed together.

3. The tool of claim 1, wherein the elongated body portion is generally of a uniform thickness.

4. The tool of claim 1, further comprising a second scraper edge extending from a second end of the elongated body portion, distal from the generally U-shaped hook.

5. The tool of claim 4, wherein the second scraper edge is continuous and flat.

6. The tool of claim 4, wherein the second scraper edge is aligned with the elongated body portion.

7. The tool of claim 4, wherein the second scraper edge is generally a same width as the scraper edge that terminates the generally U-shaped hook.

8. The tool of claim 4, wherein an end of the elongated body portion tapers towards the second scraper edge.

9. The tool of claim 1, further comprising a nail pulling aperture positioned between the elongated body portion of the tool and the pivot of the generally U-shaped hook.

10. The tool of claim 9, wherein the nail pulling aperture comprises one or more beveled edges configured to engage an underside of a nail head received in the nail pulling aperture.

11. The tool of claim 1, wherein the bight of the generally U-shaped hook extends generally parallel to the elongated body portion.

12. The tool of claim 11, wherein the second leg portion of the generally U-shaped hook extends at an angle between the bight and the elongated body portion.

13. The tool of claim 1, wherein the generally U-shaped hook is wider than the elongated body portion.

14. The tool of claim 13, wherein the scraper edge forms a widest portion of the generally U-shaped hook.

15. The tool of claim 1, wherein the first leg portion extends through an axis of elongation of the elongated body portion such that the axis of elongation extends between the scraper edge and the bight of the generally U-shaped hook.

16. The tool of claim 15, wherein a portion of the first leg portion of the generally U-shaped hook proximal to the scraper edge also extends through the axis of elongation.

17. The tool of claim 1, wherein the work piece engaging portion has a width to thickness ratio that is approximately greater than 3:1.

18. The tool of claim 1, wherein at least some of the elongated body portion is wrapped in a grip material.

19. The tool of claim 1, wherein the bight portion of the generally U-shaped hook is configured to engage the work piece received within the generally U-shaped configuration.

20. The tool of claim 1, wherein the scraper edge is continuous and flat.

21. The tool of claim 1, wherein the work piece is received in the generally U-shaped hook such that the elongated body portion is disposed forward of at least a portion of the work piece.

22. The tool of claim 1, wherein, when the work piece is secured to a substrate, the scraper edge is configured to initially separate the work piece from the substrate, and to act as a wedge to allow the first leg portion of the generally U-shaped hook to be positioned between the work piece and the substrate.

23. The tool of claim 1, wherein the generally uniform thickness of the generally U-shaped hook is configured prevent distortion of the work piece and/or a substrate into which the work piece is secured when a user of the tool is performing the prying action.

24. The tool of claim 20, wherein the continuous and flat configuration of the scraper edge is configured prevent distortion of the work piece and/or a substrate into which the work piece is secured when a user of the tool is performing the prying action.

25. The tool of claim 9, wherein the nail pulling aperture is formed in an intermediate portion of the generally U-shaped hook.

26. The tool of claim 10, wherein the nail pulling aperture is configured to facilitate utilizing the pivot to exert force on the nail head and pulling the nail away from a substrate into which the nail is driven.

27. The tool of claim 9, wherein the nail pulling aperture includes a pair of opposing nail engaging wedges, each comprising a pair of the beveled edges that are angled towards each other, wherein the beveled edges are configured to pull a nail slightly out of a substrate and position the beveled edges between a nail head and the substrate such that the nail is pulled out of the substrate from the engagement of the nail head and the nail pulling wedge.

28. The tool of claim 1, wherein the first leg portion of the generally U-shaped hook is generally flat and extends generally along an axis that is generally perpendicular to an axis of elongation for the elongated body portion.

29. The tool of claim 1, wherein the first leg portion of the generally U-shaped hook is generally of a uniform thickness prior to tapering at a distal end portion thereof into the scraper edge.

* * * * *